United States Patent [19]

Zenz

[11] Patent Number: 4,947,803

[45] Date of Patent: Aug. 14, 1990

[54] FLUDIZED BED REACTOR USING CAPPED DUAL-SIDED CONTACT UNITS AND METHODS FOR USE

[75] Inventor: Frederick A. Zenz, Garrison, N.Y.

[73] Assignee: HRI, Inc., Lawrenceville, N.J.

[21] Appl. No.: 348,848

[22] Filed: May 8, 1989

[51] Int. Cl.[5] ..... F22B 1/00

[52] U.S. Cl. ..... 122/4 D; 110/245; 165/104.16; 422/146

[58] Field of Search ..... 122/4 D; 110/245; 431/7, 170; 165/104.16; 422/146

[56] References Cited

U.S. PATENT DOCUMENTS

| | | | |
|---|---|---|---|
| 4,211,186 | 7/1980 | Pearce | 122/4 D |
| 4,409,926 | 10/1983 | Moore | 122/4 D |
| 4,770,237 | 9/1988 | Morin et al. | 165/104.16 |
| 4,879,958 | 11/1989 | Allen et al. | 110/245 |

*Primary Examiner*—Edward G. Favors
*Attorney, Agent, or Firm*—Fred A. Wilson

[57] ABSTRACT

A fluidized bed gas-solids contact reactor, which utilizes at least one capped concentric dual-sided riser-downcomer unit having a central inner riser passageway and a concentric outer downcomer passageway. The riser-downcomer unit is usually located above the fluidized bed, and is adapted for directing the downflowing solids back into the fluidized bed for recycle. The reactor unit inner and outer passageway surfaces include a heat exchange panel having inner and outer channels each containing a circulating liquid. Particulate solids from the dense phase fluidized bed are continuously circulated in dilute phase through the riser-downcomer unit passageways by a reactant gas to exchange heat with the liquid. The particulate solids can be a catalyst or a fuel material. The invention also includes a combustion system and method for combusting a particulate fuel such as coal in air to generate pressurized saturated liquid for producing saturated steam. The coal feed particles are substantially completely reacted or combusted during their controlled passage through the reactor unit, and ash can be withdrawn from the lower portion of the fluidized bed.

20 Claims, 3 Drawing Sheets

FLUDIZED BED REACTOR USING CAPPED DUAL-SIDED CONTACT UNITS AND METHODS FOR USE

BACKGROUND OF INVENTION

This invention pertains to a fluidized bed gas-solids contact reactor utilizing a dual-sided contactor unit having integral concentric walls adapted for heat exchange with a liquid therein. It pertains particularly to such a reactor using a capped dualsided concentric riser-downcomer unit containing a liquid and located in a module, and which reactor is principally useful for combusting fluidized particulate fuels such as coal to heat the liquid and generate saturated liquid or steam.

The use of fluidized beds has been recognized as an advantageous way of reacting gases and solids such as for generating heat, for example by use with heat exchanger tubes in boilers for generating pressurized steam from feed water passing in heat exchange relation with hot combustion gases from the fluidized bed of fuel. The fluidized bed utilizes a particulate carbonaceous fuel such as coal, and is fluidized by passing air upwardly through the bed to provide the combustion reaction. Advantages of such fluidized bed combustion systems include increased heat transfer rates, increase in combustion efficiency, and reduction in boiler size.

One known form of a gas-solids contactor is disclosed by U.S. Pat. No. 3,826,783 to Zenz, which discloses a folded transfer line reactor for circulating particulate materials for fluidized catalytic cracking (FCC) units. However, such folded riser-downcomer configurations apparently have not been previously used for fluidized bed combustors for particulate fuels such as coal for generating saturated vapors such as steam. Other types of fluidized bed combustors include U.S. Pat. No. 3,910,235 to Highley which discloses a fluidized bed combustion apparatus utilizing internally circulating beds each surrounded by a heat exchange jacket. Also, U.S. Pat. No. 4,240,377 to Johnson discloses a fluidized bed boiler utilizing circulating solids, and U.S. Pat. No. 4,539,939 to Johnson discloses fluidized bed combustion tubular boiler apparatus for combusting coal with limestone to generate steam.

These known large fluidized bed combustion boiler systems have been found to be undesirably complicated and difficult to control the particulate solids flow, and also are quite expensive. Such disadvantages of the prior art reactors and combustion systems have now been advantageously overcome by the present invention, which provides an improved fluidized bed reactor apparatus and method which utilizes at least one central riser and concentric downcomer unit having dual sided heat exchange configurations and located above a fluidized bed for exchanging heat with a liquid in a reactor module.

SUMMARY OF INVENTION

The present invention provides a gas-solids contact reactor having at least one circulating dilute phase solids loop provided by a central capped riser and concentric downcomer unit located above a dense phase fluidized bed, and includes a method for using same. The riser-downcomer unit has concentric inner and outer walls which each provide a cavity for containing a liquid for use with either exothermic or endothermic type reactions with gas and particulate solids passing through the unit. For exothermic reactions, the reactions between the gas and solids such as a combustion reaction heats the liquid. For endothermic reactions, the heated gas can be used either for treating the particulate solids, or alternatively the heated solids can be used for producing a reaction in the gas. The invention also includes the gas-solids contact reactor used in an improved fluidized bed system and method for combusting particulate fuel solids to generate heated liquids or vapors, and which operates at relatively low combustion temperatures and provides high heat transfer efficiency to the liquids or vapors.

The invention utilizes a circulating loop of dilute phase particulate solids entrained upwardly from the dense phase fluidized bed. The circulating solids loop is provided in at least one dual-sided concentric riser-downcomer unit adapted for handling dilute phase fluidized gas-solids therein, the unit having a capped inner riser passageway and a concentric outer downcomer passageway, so as to provide a continuous folded passageway for continuous flow and reaction of particulate solids and gases passing through the unit. In the folded passageways, the cross-sectional area is sized and flow velocities are controlled along with the particle temperature and residence time, so that the gas and particles are substantially completely reacted during passage through the downcomer passageway portion of the riser-downcomer unit above the fluidized bed.

The capped central riser and concentric outer downcomer passages of each unit are each formed by two concentric tubes sealed together at each end, so as to provide two inner and two outer walls each defining an intervening cavity or compartment therebetween to provide dual heat exchange panels, which are liquid filled. The particles are continually entrained upwardly through the central riser passageway by an upflowing secondary gas stream injected therein. Heat transfer occurs predominantly by convection and radiation between the flowing gas-solids and the exposed walls of the riser-downcomer unit and the liquid contained in the dual compartments therein. The downcomer exit is configured for effective separation of the entraining gas from the downflowing particulate solids above the fluidized bed, so that the solids are effectively returned to the bed for recirculation through the riser-downcomer unit. Such recirculation of particulate solids back to the fluidized bed may be effectively facilitated by a cylindrical skirt located radially outwardly from the downcomer passageway exit, with the skirt having its lower portion immersed in the fluidized bed.

The gas-solids contactor unit and fluidized bed are enclosed within a casing so as to form a module, which incorporates a plenum and flow distribution grid located below the fluidized bed for uniformly distributing the primary gas flow upwardly through the shallow fluidized bed. The capped riser-downcomer unit embodies the concept of particle separation by impingement, and usually utilizes an increased velocity in the riser passageway as compared to the downcomer passageway. The cross-sectional area of the annular shaped downcomer passageway usually exceeds that of the central riser passageway by an area ratio in the range of 1.5:1 to 5:1, thus providing for reduced velocity and increased particle residence time in the downcomer passageway for effective complete reaction of the particles with the gas therein. The superficial gas velocity in the central riser passageway must be sufficient to entrain particles upwardly from the fluidized bed, and is usually 15–25 ft/sec., while the superficial gas velocity in the larger area outer downcomer passageway is usually reduced to 5–15 ft/sec.

More generally the upward superficial gas velocity in the central riser passageway should exceed the terminal or free fall velocity of the largest particle desired to be conveyed vertically upward, while the downwardly flowing superficial gas velocity in the outer downcomer passageway could in the extreme be only a function of the terminal or free fall velocity of the smallest size particle being circulated.

The total cross-sectional area of the fluidized bed should exceed that of the downcomer outermost tubular wall by an area ratio of 1.5:1 to 3:1. The configuration of each capped riser-downcomer unit will depend on its desired performance. The unit height and diameter are determined by the desired contact or residence time and throughput for the particulate solids, with the ratio of height to outer diameter being at least about 8:1 and usually not exceeding about 20:1. For example, riser height or overall length of the riser and downcomer passages may be based on complete combustion of average 500 micron size coal particles. The downcomer exit can be maintained above the fluidized bed upper level by a vertical distance equal to 0.75–5 times the radial width of the annular downcomer passageway, or the downcomer exit can be preferably submerged within the bed. The rate of circulating solids flowing through the riser-downcomer passages exceeds the feed rate of fresh solids to the fluidized bed by a recycle ratio of at least about 2:1, and usually not exceeding about 10:1 ratio. The riser-downcomer recirculating loop reduces bed height, greatly improves heat transfer by dual-sided exposure to high velocity solids, and reduces particle entrainment by lowering the velocity of the particles during their return to the shallow fluidized bed. The fluidized bed unit is designed for ease of fabrication, installation, cleaning and maintenance. A preferred design for a larger capacity reactor system can consist of multiple modules each containing a capped riser-downcomer unit arranged in parallel configuration in an assembly.

This invention also provides a method for contacting gassolids in a reactor having a dense phase fluidized bed provided below a dilute phase capped riser-downcomer unit. This invention is useful for reacting a gas with particulate solids having a wide size range of 0.001 micron to 0.50 inch. The invention can be used for burning coke deposits from catalyst particles as in the regeneration of petroleum cracking catalysts, for cooling or heating gases undergoing reactions in the presence of a conveyed solids or catalyst particles as in roasting of mineral ores, chlorination of rutile, or production of acrylonitrile or oxychlorination of hydrocarbons, or for combustion of particulate solids such as coal to generate heated liquids such as saturated steam. Temperature rise across the folded flow passageways of the contactor unit can be as small as 10° F. or as great at 1800° F. depending upon the process used. The invention is particularly useful for combusting particulate fuels such as coal, coke, and oil shales together with a particulate sorbent material such as limestone in a fluidized bed below a dual-sided riser-downcomer unit having a central riser passageway and a concentric outer downcomer passageway in a module.

This invention advantageously provides a compact and efficient gas-solids reactor or system and a method for contacting gas and particulate solids either to exothermically heat a circulating liquid, or for endothermically heating the gas and solids by the circulating liquid. It particularly provides an improved method for combusting particulate fuels such as coal to heat a liquid to generate saturated vapors, such as for heating pressurized water to generate saturated steam. To provide desired high percentage turndowns for the reactor or system, one or more capped riser-downcomer units can be utilized and the turndown percentage adjusted by feedrate variation to each riser-downcomer unit.

BRIEF DESCRIPTION OF DRAWINGS

The invention will be further described with reference to the following drawings, in which.

DESCRIPTION OF INVENTION

Figure 1:
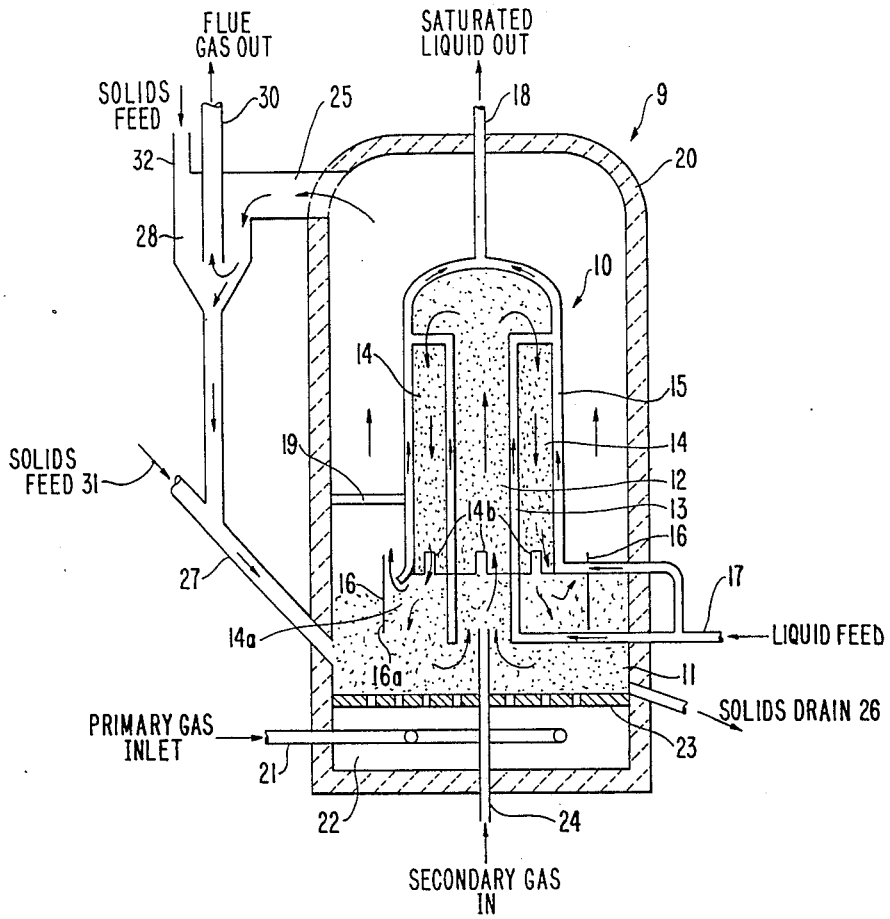
FIG. 1 shows a gas-solids contact reactor module having a capped central riser passageway surrounded by a concentric downcomer passageway provided above a fluidized bed within a housing.

A fluidized bed gas-solids reactor module including a single capped dual-sided circulating solids contactor unit is generally shown in FIG. 1. The reactor module 9 consists of a shallow dense phase fluidized bed 11 and a central dilute phase capped riser-downcomer unit 10 having a central riser passageway 12 and a concentric outer downcomer passageway 14, which are centrally located above the fluidized bed 11 in an enclosure or vessel 20. An inner compartment 13 containing a liquid is provided between the passageways 12 and 14, and an outer compartment 15 also containing a liquid is provided surrounding downcomer passageway 14. The enclosure or vessel 20 can be made cylindrical or rectangular shaped.

The downcomer passageway exit zone 14*a* is configured to provide effective separation of solids from the entraining gas and for directing the downflowing solids back into the fluidized bed 11 for return to the mouth of riser 12 so as to promote solids recycle through the riser-downcomer unit 10. To help assure such recycle of particulate solids to the fluidized bed, a cylindrical baffle 16 may be provided and located radially outwardly from downcomer exit 14*a* at a location intermediate the exit 14*a* and the enclosure 20 inner wall, with the baffle lower portion 16*a* being immersed within fluidized bed 11. The radial distance or spacing between the downcomer exit 14*a* and baffle 16 should be 1–2 times the maximum radial width of downcomer passageway 14, so as to provide a lower gas velocity within the baffle 16 than that in downcomer passageway 14. Also if desired, a plurality of vertical serrations or slots 14*b* can be provided circumferentially spaced apart around the lower end of passageway 14 outer wall to facilitate the escape of gas radially outwardly and upwardly from the solids downflowing in downcomer passageway 14.

Figure 2A:
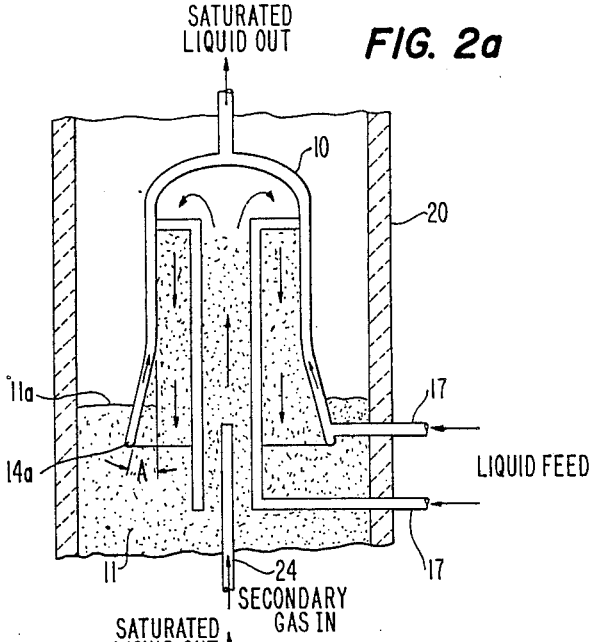
FIGS. 2*a* and 2*b* show a schematic view of two alternative configurations for the lower portion of the reactor downcomer passageway relative to the fluidized bed.
Figure 2B:
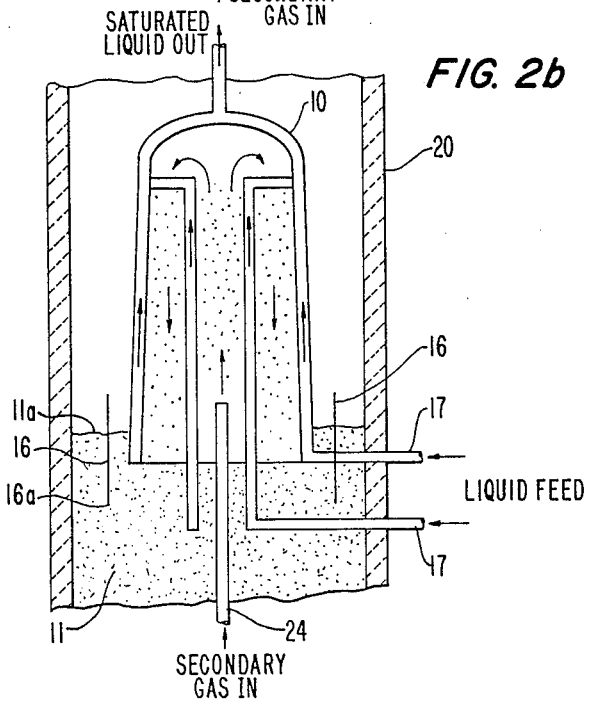

FIG. 2 shows two alternative configurations for the downcomer passageway exit zone 14*a* relative to upper level 11*a* of the flu idized bed 11. In FIG. 2(*a*) the fluidized bed upper level 11*a* is located above the lower end of the downcomer exit 14*a* . The lower portion of outer wall 15*a* can be flared outwardly by an angle A of 0°–45° with a vertical plane, so as to reduce downward velocity and facilitate separation of the downflowing gas from the particulate solids. Also if desired, substantially the entire outer wall 15*a* can be tapered outwardly and used in combination with the cylindrical baffle 16, as shown by FIG. 2(*b*).

The riser-downcomer unit 10 is provided with dual concentric compartments 13 and 15 each formed by two concentric cylindrical walls. Thus, the passageways 12 and 14 are completely liquid-lined on all sides for heat absorption or heating by a liquid, with only limited heat removal or introduction to the liquid being provided via the shallow fluidized bed 11. The inner compartment 13 is contained between the two inner walls, the outer compartment 15 is provided between the two outer walls, and both compartments 13 and 15 are both connected to a source 17 of a heating or cooling liquid. Saturated liquid generated in the compartments 13 and 15 from an exothermic reaction in the riser and downcomer passageways is withdrawn at upper outlet conduit 18. Structural support for the riser-downcomer unit 10 within enclosure 20 can be advantageously provided by the central conduit 18, in combination with three lateral stabilizing struts 19 provided near the lower end of the unit 10 and extending between the unit and walls of casing 20.

Each module 9 is also provided with a source of primary reactant feed gas or air 21 into a plenum 22 and flow distributor 23 for fluidizing the bed 11, and has a supply of secondary reactant gas or air provided at 24 upwardly into the riser 12 for producing continuous circulation of solids through the loop. Such dual gas entry is particularly advantageous to reactions in which feed gases should not be premixed because of explosive or uncontrolled side reactions, such as for air, ammonia or ethylene in their reaction to form acrylonitrile and in similar processes involved in pyridine chemistry and the production of niacins. Bed drain 26 can provide for removal of spent catalyst, or removal of hot ash and spent limestone from the fluidized bed 11. A primary cyclone separator 28 provides gas-solids separation from exit gases. Gas is withdrawn from the cyclone at outlet 30, and particulate solids are recycled via conduit 27 back to the fluidized bed 11 for further combustion.

Figure 3:
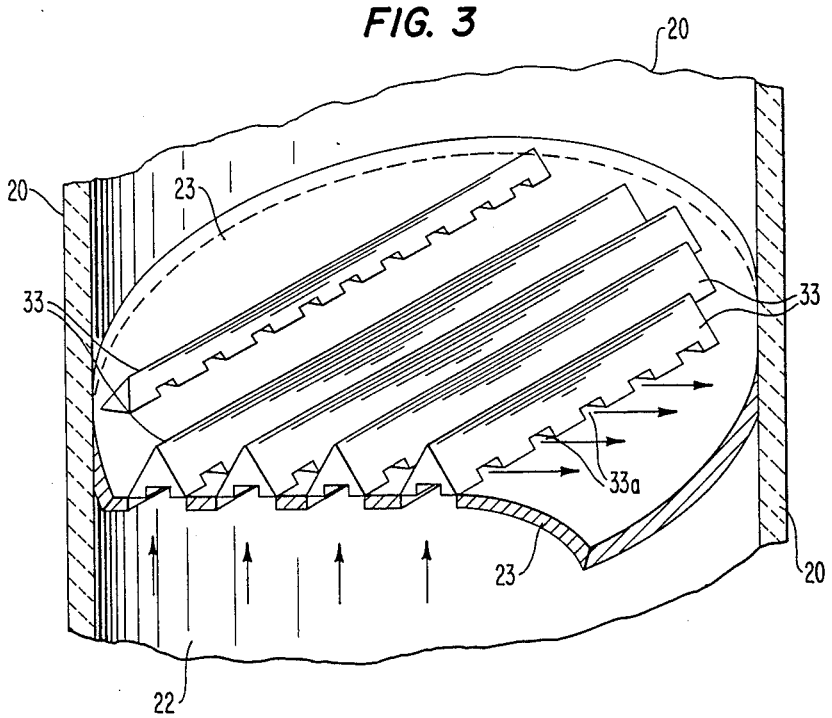
FIG. 3 shows a partial perspective view of a grid device for flow distribution of gas upwardly into the fluidized bed of the reactor.

During operation of the reactor as a fuel combustion unit, a particulate fuel such as crushed coal and a sorbent material such as limestone are fed to each module 9 at inlet 31 through cyclone dipleg 27. These fuel materials are preferably fed at alternative feed location 32 adjacent to the primary cyclone gas outlet 30. Such an arrangement for contacting of the cold solids feed material with hot 1000° F.+ flue gas from the fluidized bed heats the feed solids rapidly to 900° F.+ temperature, before the solids enter the shallow fluidized bed 11 of the reactor via the cyclone dipleg conduit 27. The primary air introduced into the reactor plenum 22 is uniformly distributed upwardly into the fluidized bed 11 by an apertured distribution grid 23. The grid 23 can be made substantially flat or conical-shaped, and preferably consists of multiple pieces of inverted metal angle 33 having a plurality of holes 33*a* oriented substantially horizontally therein, as generally shown by FIG. 3. Introducing the primary gas laterally into the fluidized bed serves to prevent high upward velocities of the particles and resulting erosion of the lower end portion of compartment 13. The secondary air introduced into the bottom of the riser passageway 12 is used for transporting the fluidized bed particulate material continuously upwardly in the riser 12, and also for providing the gas such as oxygen necessary for the reaction or combustion of the solids such as a fuel occurring in the riser and downcomer continuous passages.

The single entry for coal and limestone feed to the fluidized bed via the primary cyclone dipleg is oriented so as to preferentially feed the fresh solids into the fluidized bed. Also, the reactor bed solids drain 26 is located as far as possible away from the cyclone dipleg 27 entry, so as to minimize bypass losses of fresh particulate coal and limestone from the fluidized bed 11. The rate of gas flowing upwardly through the bed 11, needed to fluidized the bed, is dependent on the size and density of the particles comprising the bed, and should usually be 3–20 ft/sec. The superficial gas velocity of the secondary air upwardly into the riser passageway 12 should be sufficient to entrain the dilute phase particulate solids therein from the dense phase fluidized bed and should usually be 15–30 ft/sec. For coal combustion the fluidized bed temperature is usually 1200°–1600° F. and the temperature rise of burning coal particles in the riser and downcomer passage is 5°–100° F., as the exothermic heat of combustion is continuously removed. At the downcomer exit 14*a*, the downflowing gas reverses direction and rises upwardly towards gas exit 25, while the remaining uncombusted particles are returned by momentum and bed impingement downwardly into the fluidized bed 11 for further combustion and recycle to the riser 12. Both the primary and secondary air streams are preferably preheated against warmer effluent streams, such as the reactor hot effluent gas at 25.

Figure 4:
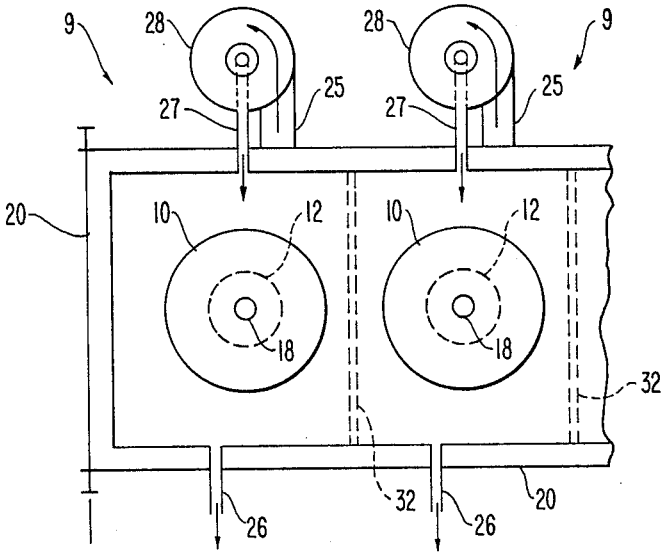
FIG. 4 shows a plan view of multiple reactor modules each containing a gas-solids contact reactor unit according to the invention.

Each module 9 can be conveniently sized for a desired capacity, such as for a combustion system burning coal and producing about 10,000 lb/hr of saturated steam. Each module is preferably square-shaped and arranged to be individually shop fabricated, and can be joined together with other adjacent modules for a particular installation. Multiples of module 9 can be used as required for a larger capacity system, as shown by FIG. 4. Each module 9 can be separated from the adjacent module by a plenum partition wall 32.

This invention will be further described in the following example, which should not be construed as limiting the scope of the invention.

EXAMPLE

A typical fluidized bed combustion reactor module consists of a dense phase fluidized bed located in a vessel below a riserdowncomer unit. Crushed coal and limestone are fed into the fluidized bed through a conduit in primary gas-solids cyclone separation unit for preheating the feed materials before they enter the shallow fluidized bed via a cyclone dipleg conduit. The riser and downcomer passages are formed by four concentric tubes and which provide an inner and an outer cavity filled with boiler feed water for heating the water to generate saturated steam. Primary air is distributed from a plenum uniformly upwardly into the fluidized bed by an apertured grid. Secondary air is injected upwardly into the riser passageway at velocity sufficient to produce controlled velocity and particle residence time and via recycle of solids to the fluidized bed provide substantially complete combustion of the coal.

Important characteristics of a typical reactor containing a fluidized bed below a capped riser-downcomer unit for combustion of coal together with limestone are provided in Table 1 as follows:

TABLE 1

| | |
|---|---|
| Fluidized bed depth, ft. | 4 |
| Superficial gas velocity in fluidized bed, ft./sec. | 10 |
| Riser passageway height, ft. | 20 |
| Downcomer passageway height, ft. | 18 |
| Cross-sectional area ratio of downcomer to riser passageways | 2:1 |
| Superficial gas velocity in riser, ft./sec. | 20–30 |
| Superficial gas velocity in downcomer, ft./sec. | 10–15 |
| Height of downcomer exit above or below fluidized bed upper level, ft. | +1.5 to −1.5 |
| Fluidized bed coal and limestone particles size, microns | 200–700 |

The resulting flue gases are passed through a cyclone separator for removal of solids which are recycled back to the fluidized bed, while ash and limestone solids are withdrawn from the bed lower portion.

Although this invention has been described broadly and in terms of preferred embodiments, it will be understood that modifications and variations can be made and that some features can be used without others all within the spirit and scope of the invention, which is defined by the following claims.

I claim:

1. A fluidized bed gas-solids reactor, comprising:

(a) an enclosure vessel having a reaction chamber provided in its lower portion containing a dense phase fluidized bed of particulate solids material:

(b) means for feeding fresh particulate solids material into the fluidized bed in the reaction chamber;

(c) a riser-downcomer unit having a central riser passageway flow connected to a concentric outer downcomer passageway, said unit extending substantially vertically within said vessel with the downcomer passageway exit being located near the upper level of the fluidized bed, and being configured for directing downflowing particulate solids from the downcomer passageway back to the fluidized bed, said riser downcomer unit including dual concentric compartments each forming heat exchange panel means provided on its adjacent walls for containing a liquid;

(d) distributor means for introducing primary gas upwardly into the fluidized bed, and means for introducing secondary gas upwardly into the central riser passageway; and (e) a cyclone separator flow connected to the vessel upper end portion for outward passage of gases and entrained solids therethrough, whereby particulate solids can be fed into the fluidized bed and circulated in dilute phase through the riser-downcomer unit passageways in heat exchange relation with the panel walls and liquid therein, and the particulate solids collected in the gassolids cyclone separator can be recycled back to the fluidized bed.

2. A gas-solids reactor according to claim 1, wherein a cylindrical-shaped baffle is provided spaced outwardly from said downcomer passageway exit for directing the downflowing particulate solids back to the fluidized bed.

3. A gas-solids reactor according to claim 1, wherein said distributor means includes a plurality of flow conduits having openings which are oriented substantially horizontally for supplying the primary gas into said fluidized bed.

4. A gas-solids reactor according to claim 1, including means for introducing a liquid into a lower portion of said heat exchange panel means, and means provided at the upper end of the panel for withdrawing heated or cooled fluid from the panel means.

5. A gas-solids reactor according to claim 1, wherein the cross-sectional area of the downcomer passageway exceeds that of the riser passageway by a ratio in the range of 1.5:1 to 3:1.

6. A gas-solids reactor according to claim 1, wherein the ratio of height to outer diameter for the riser-downcomer unit is between 8:1 and 20:1.

7. A gas-solids reactor according to claim 1, wherein the fluidized bed upper level is maintained above the downcomer passageway exit by a distance equal to 0.75–5 times the radial width of the downcomer passageway.

8. A gas-solids reactor according to claim 1, wherein the particulate solids feed means is arranged in heat exchange relation with the gases passing outwardly through said cyclone separator, so that the feed particles can be combined with the solid particles being recycled from the cyclone back to the fluidized bed.

9. A gas-solids reactor according to claim 1, including means for solids withdrawal from the lower portion of the fluidized bed in heat exchange relation with the feed liquid.

10. A gas-solids reactor according to claim 1, wherein multiple modules each containing a riser-downcomer unit are combined to provide a larger capacity reactor system.

11. A gas-solids reactor according to claim 1, further including a plurality of reactor modules each containing a riser-downcomer unit are provided within a system, with the spacing between adjacent said units being 1.5–2.5 times the unit outer diameter.

12. A fluidized bed gas-solids reactor system, comprising:

(a) a vessel having a reaction chamber provided in its lower portion containing a fluidized bed of particulate solids material;

(b) means for feeding fresh particulate solids material into the fluidized bed in the reaction chamber;

(c) at least one riser-downcomer unit having a central riser passageway flow connected to a concentric outer downcomer passageway, said unit extending substantially vertically within said vessel, with the downcomer passageway exit being located above the upper level of the fluidized bed and being configured for directing particulate solids from the downcomer passageway directly back to the fluidized bed, said riser-downcomer unit including dual concentric compartments each forming heat exchange panel means provided on its adjacent walls for containing a liquid therein;

(d) distributor means for introducing primary gas upwardly into the fluidized bed, and means for introducing secondary gas upwardly into the central riser passageway;

(e) means for feeding a liquid into a lower portion of the heat exchange panel, and means for withdrawal of saturated liquid provided at the upper portion of the panel wall; and (f) a cyclone separator located adjacent said reactor vessel and flow connected to the vessel upper end portion for outward passage of gas and entrained solids therethrough, whereby particulate solids can be fed into the fluidized bed and circulated in dilute phase through the riserdowncomer unit passageways in heat exchange relation with the panel walls and liquid contained therein and particulate solids collected in the cyclone separator can be recycled back to the fluidized bed.

13. A fluidized bed combustion and heat transfer system for generating a heated liquid, comprising:

(a) a vessel having a combustion chamber provided in its lower portion containing a fluidized bed of particulate solids fuel material;

(b) means for feeding the particulate solids fuel material into the fluidized bed in the lower portion of the combustion chamber;

(c) at least one reactor module containing a riser-downcomer unit having a central riser passageway flow connected to a concentric outer downcomer passageway, said unit extending substantially vertically within said combustion chamber with the downcomer passageway exit being located above the upper level of the fluidized bed and configured for directing downflowing particulate solids from the downcomer passageway, said riser-downcomer unit including dual concentric compartments in heat exchange panel means provided between its adjacent walls, each said panel containing liquid flow compartment therein;

(d) distributor means for introducing primary air upwardly into said fluidized bed, and means for introducing secondary air upwardly into said central riser to entrain particles from the fluidized bed into the riser;

(e) means for feeding a liquid into a lower portion of the heat exchange panel, and means for withdrawal of saturated liquid provided at the upper portion of the panel wall;

(f) a cyclone separator located adjacent said combustor vessel for each said module and flow connected to the vessel upper end; and (g) means for withdrawing ash solids from the lower portion of said fluidized bed, whereby particulate fuel solids can be fed into the fluidized bed and circulated in dilute phase through the riser-downcomer unit passageways in heat exchange relation with the panel liquid therein and the fuel combusted during passage through each said module, so as to produce flue gases and heat a liquid contained in the heat exchange panel passages, and particulate solids are collected in the cyclone separator and recycled to the fluidized bed.

14. A method for reacting a gas and particulate solids in a fluidized bed reaction system, comprising:

(a) feeding particulate reactive or catalytic solids into a dense phase fluidized bed located in a vessel below at least one riser-downcomer contact unit having a central riser passageway and a concentric outer downcomer passageway;

(b) feeding a primary gas upwardly into the fluidized bed to fluidized the bed, and feeding a secondary gas upwardly into the riser passageway to entrain particles from the fluidized bed into the riser passageway;

(c) feeding vaporizable liquid into the lower portion of a dual-sided heat exchange panel included in said riserdowncomer unit;

(d) continuously passing a portion of the particulate solids in dilute phase upwardly from said fluidized bed through said central riser passageway and then downwardly through said concentric outer passageway back to the fluidized bed at a temperature and flow rate selected to substantially completely react the feed gases with the solids; and (e) heating the liquid in said panel to generate a saturated liquid, and withdrawing the saturated liquid from the upper portion of the panel.

15. The gas-solids reaction method of claim 14, wherein the superficial upward gas velocity in the riser passageway is 15–30 ft/sec, and the superficial gas velocity in the downcomer passageway is 5–15 ft/sec.

16. The gas-solids reaction method of claim 14, wherein the recycle ratio of solids circulating through the riser-downcomer passages exceeds the fresh solids feed rate by a ratio of at least 2:1.

17. The reaction method of claim 14, wherein solids exiting the downcomer passageway are substantially returned to the fluidized bed, and gases are passed to a cyclone gas-solids separator from which particulate solids are returned to the fluidized bed.

18. The gas-solids reaction method of claim 14, wherein the particulate solids are coal and limestone, and the vaporizable liquid is water.

19. The gas-solids reaction method of claim 18, including withdrawing unburned fuel ash and limestone from the lower portion of said fluidized bed.

20. A method for combusting particulate solids fuel in a fluidized bed combustion system, comprising:

(a) feeding particulate fuel solids into a dense phase fluidized bed located in a vessel below at least one riserdowncomer contact unit having a central riser passageway and a concentric outer downcomer passageway;

(b) feeding primary air upwardly into the fluidized bed, and feeding secondary air upwardly into the riser passageway at a superficial velocity of 15–30 ft/sec to entrain particles from the fluidized bed into the riser passageway;

(c) feeding water into the lower portion of dual heat exchange compartments included in said riser-downcomer unit;

(d) continuously passing a portion of the particulate fuel solids in dilute phase upwardly from said fluidized bed through said central riser passageway and then downwardly through said concentric outer passageway back into the fluidized bed at a temperature and rate selected to substantially completely combust the fuel solids;

(e) heating the water in said compartments to generate saturated steam, and withdrawing the saturated steam from the upper portion of the panel; and (f) passing the flue gases to a cyclone separator from which fine unburned solids are returned to the fluidized bed.

* * * * *